US008936350B2

(12) United States Patent
Takei et al.

(10) Patent No.: US 8,936,350 B2
(45) Date of Patent: Jan. 20, 2015

(54) PRINT HEAD AND INKJET PRINTING APPARATUS

(75) Inventors: Yasunori Takei, Tokyo (JP); Kenji Yabe, Yokohama (JP); Takuma Kodoi, Kawasaki (JP); Ken Ikegame, Ebina (JP); Isamu Horiuchi, Yokohama (JP); Hyou Takahashi, Kunitachi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/115,968

(22) PCT Filed: May 31, 2012

(86) PCT No.: PCT/JP2012/003621

§ 371 (c)(1),
(2), (4) Date: Nov. 6, 2013

(87) PCT Pub. No.: WO2012/172744

PCT Pub. Date: Dec. 20, 2012

(65) Prior Publication Data

US 2014/0125735 A1 May 8, 2014

(30) Foreign Application Priority Data

Jun. 13, 2011 (JP) ..... 2011-131155

(51) Int. Cl.
*B41J 2/14* (2006.01)
*B41J 2/16* (2006.01)

(52) U.S. Cl.
CPC *B41J 2/14* (2013.01); *B41J 2/1639* (2013.01); *B41J 2/1603* (2013.01); *B41J 2/1631* (2013.01); *B41J 2/1404* (2013.01);
(Continued)

(58) Field of Classification Search
None
See application file for complete search history.

(56) References Cited

U.S. PATENT DOCUMENTS 6,123,413 A 9/2000 Agarwal et al.
7,399,060 B2 7/2008 Tsuchii (Continued)

FOREIGN PATENT DOCUMENTS

CN 101310983 A 11/2008
CN 101659152 A 3/2010

(Continued)

OTHER PUBLICATIONS

International Preliminary Report on Patentability dated Jan. 3, 2014, in Application No. PCT/JP2012/003621.

(Continued)

*Primary Examiner* — Lamson Nguyen
(74) *Attorney, Agent, or Firm* — Fitzpatrick, Cella, Harper & Scinto

(57) ABSTRACT

A print head includes an energy generating element, a chamber for accommodating liquid, and an ejection opening for ejecting liquid from the chamber, thus applying the energy to the liquid in the chamber from the energy generating element to eject the liquid from the ejection opening, wherein the ejection opening includes at least two projections convex to an inside of the ejection opening in a cross section perpendicular to a liquid ejecting direction and has a tapered angle Θ1 in regard to the liquid ejecting direction, enabling a meniscus of the liquid to be formed therebetween at the liquid ejecting time, and an outer edge portion has a tapered angle Θ2 in regard to the liquid ejecting direction, wherein the tapered angles Θ1 and Θ2 are defined to meet a formula of $0° \leq \Theta 1 \leq 10°$ and a formula of $\Theta 2 > \Theta 1$.

6 Claims, 9 Drawing Sheets

(52) U.S. Cl.
CPC .... *B41J 2002/14169* (2013.01); *B41J 2202/11* (2013.01); *B41J 2002/14475* (2013.01)
USPC ..... 347/47

(56) References Cited

U.S. PATENT DOCUMENTS

| | | | | |
|---|---|---|---|---|
| 7,506,962 | B2 | 3/2009 | Murakami et al. | |
| 7,824,009 | B2 | 11/2010 | Takei | |
| 7,887,159 | B2 | 2/2011 | Takei et al. | |
| 7,954,927 | B2 * | 6/2011 | Hart et al. | 347/47 |
| 7,980,663 | B2 | 7/2011 | Matsumoto et al. | |
| 8,282,194 | B2 * | 10/2012 | Ozawa | 347/47 |
| 8,556,382 | B2 * | 10/2013 | Kang | 347/47 |
| 2008/0291245 | A1 | 11/2008 | Takei | |

FOREIGN PATENT DOCUMENTS

| | | | |
|---|---|---|---|
| EP | 1 995 069 | A1 | 11/2008 |
| JP | 10-235874 | A | 9/1998 |
| JP | 2006-82478 | A | 3/2006 |
| JP | 2006-159616 | A | 6/2006 |
| JP | 2008-119955 | A | 5/2008 |
| JP | 2008-290379 | A | 12/2008 |

OTHER PUBLICATIONS

International Search Report mailed Jul. 10, 2012, in International Application No. PCT/JP2012/003621.

Office Action issued in Chinese Patent Application No. 201280028443.0, dated Nov. 4, 2014.

* cited by examiner

PRINT HEAD AND INKJET PRINTING APPARATUS

TECHNICAL FIELD

The present invention relates to a print head which ejects a liquid of ink or the like on various types of medium for printing, and an inkjet printing apparatus using the print head.

BACKGROUND ART

As to a method of ejecting a liquid of ink or the like, there is known a method of controlling an ejection energy generating element of a thermoelectric conversion element (heater) or the like by an electrical signal to eject liquid drops from an ejection opening of a print head.

In response to a recent demand for printing with high quality, the downsizing of the liquid drop ejected from the print head has been made. Due to the small-sized liquid drop, there is a tendency that an influence of a phenomenon where liquid drops ejected from the print head are divided into liquid drops (hereinafter, called main drops) which should be originally used for printing and side minuscule liquid drops (hereinafter, called satellites) is noticeable. For example, there are some cases where degradation of image quality is caused by the event that the satellite lands on a print medium. Further, the satellite loses its speed before reaching the print medium to be formed as floating liquid drops (hereinafter, called mists), possibly causing contamination of the printing apparatus or the print medium.

For a reduction of the satellite, for example, as described in PTL 1, it is known to shorten a length of an ink tail in the ejected liquid drop. PTL 1 discloses a technology that an ejection opening is formed in a non-circular shape, for example, in a sand clock shape to partially reduce a dimension of an opening part of the ejection opening, whereby meniscus forces are increased, which reduces stir of a liquid surface from the ejection opening to shorten the ink tail.

CITATION LIST

Patent Literature

PTL 1: Japanese Patent Laid-Open No. H10-235874 (1998)

SUMMARY OF INVENTION

PTL 1 discloses the technology that the dimension of the opening part of the ejection opening is partially reduced for the satellite reduction. However, the construction in PTL 1 assumes the ejection opening having a larger dimension than the ejection opening used in the recent print head for high image quality. In addition, PTL 1 does not refer to an ejection defect at a printing start and has no descriptions of the improvement. That is, factors causing the ejection defect of the liquid at the printing start include the event that the liquid in the ejection opening is vaporized while the printing is stopped, to increase the viscosity, which makes the liquid difficult to be ejected. As in the case of PTL 1, even in the construction where the dimension of the opening part in the ejection opening is partially reduced, there are some cases where the ejection defect of the liquid at the printing start is generated depending on the configuration in the ejection opening.

An object of the present invention is to provide a print head which is provided with ejection openings for achieving both of a reduction of phenomena of satellites and mists and an improvement on an ejection defect at a printing start and is capable of printing with high quality, and an inkjet printing apparatus provided with the print head.

For solving the above problem, a print head according to the present invention comprises, an energy generating element, a chamber for accommodating liquid to which energy is applied from the energy generating element, and an ejection opening for ejecting the liquid from the chamber to an outside, thus applying the energy to the liquid in the chamber from the energy generating element to eject the liquid from the ejection opening, wherein the ejection opening includes:

at least two projections each of which is convex to an inside of the ejection opening in a cross section perpendicular to a direction of ejecting the liquid and has a tapered angle $\Theta 1$ in regard to the direction of ejecting the liquid, enabling a meniscus of the liquid to be formed therebetween at the time of ejecting the liquid from the ejection opening; and an outer edge portion which is a section of the ejection opening different from the at least two projections and has a tapered angle $\Theta 2$ in regard to the direction of ejecting the liquid, wherein the tapered angle $\Theta 1$ and the tapered angle $\Theta 2$ are defined to meet a formula of $0° \leq \Theta 1 \leq 10°$ and a formula of $\Theta 2 > \Theta 1$.

The print head according to the present invention includes the ejection opening which is sized to be larger from an outlet side toward an inside of the print head and has the projections capable of holding a surface of the meniscus of the liquid formed inside of the ejection opening in the liquid ejecting process, in the vicinity of the outlet in the ejection opening. The print head according to the present invention with such a construction can shorten a length of the ink tail in the liquid drop ejected, thus reducing the satellite and mist, and on the other hand, provide ejection stability at a printing start.

Further features of the present invention will become apparent from the following description of exemplary embodiments (with reference to the attached drawings).

BRIEF DESCRIPTION OF DRAWINGS

FIG. 5AR is a diagram showing the ink ejection process of the print head according to the comparative example;

FIG. 5BR is a diagram showing the ink ejection process of the print head according to the comparative example;

FIG. 5CR is a diagram showing the ink ejection process of the print head according to the comparative example;

FIG. 5DR is a diagram showing the ink ejection process of the print head according to the comparative example;

FIG. 5ER is a diagram showing the ink ejection process of the print head according to the comparative example;

FIG. 5FR is a diagram showing the ink ejection process of the print head according to the comparative example;

FIG. 5GR is a diagram showing the ink ejection process of the print head according to the comparative example;

DESCRIPTION OF EMBODIMENTS

An inkjet print head according to an embodiment in the present invention and an inkjet printing apparatus using the print head will be explained with reference to the drawings.

Figure 1:
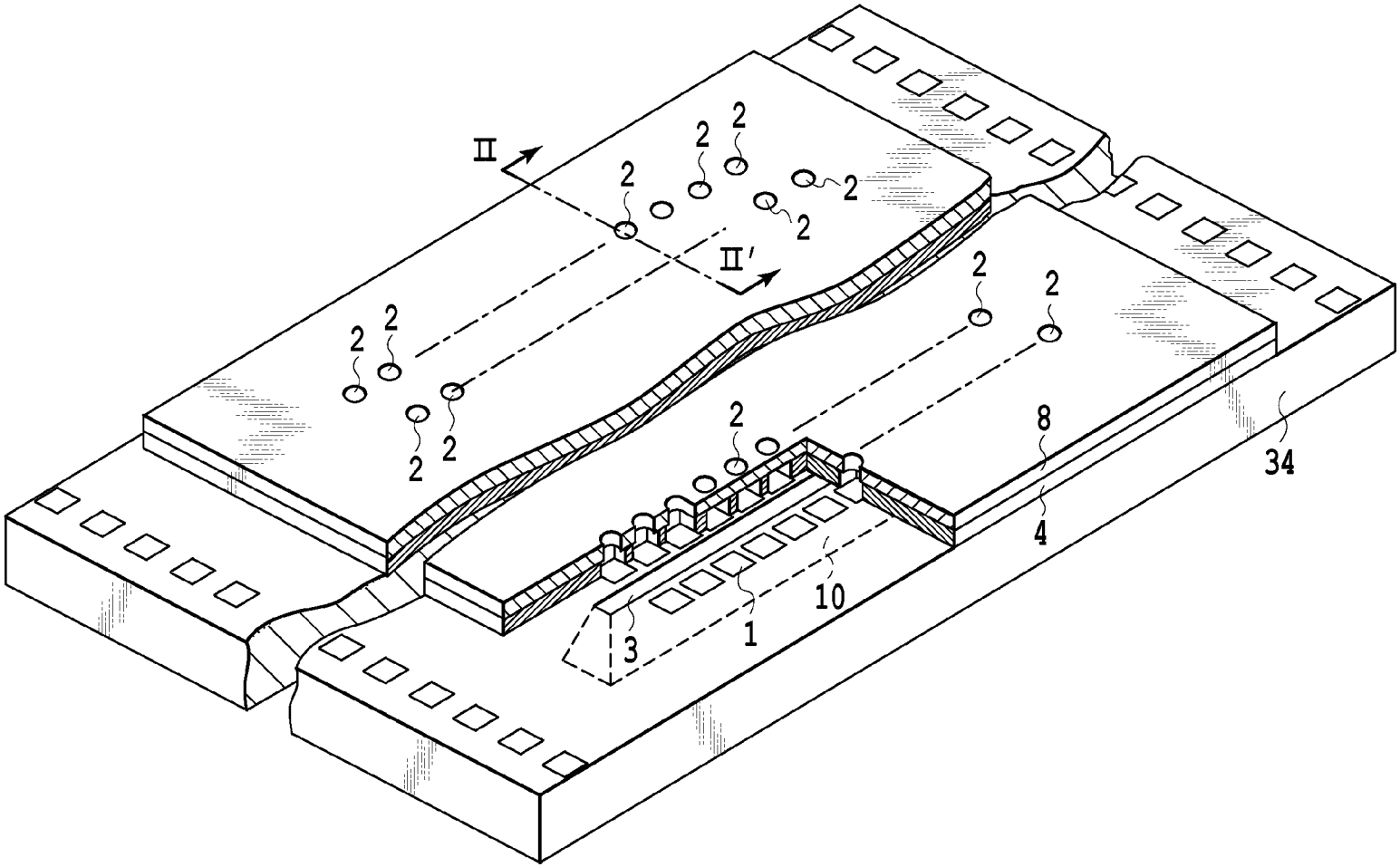
FIG. 1 is a schematic perspective view of a print head according to an embodiment in the present invention.
Figure 2:
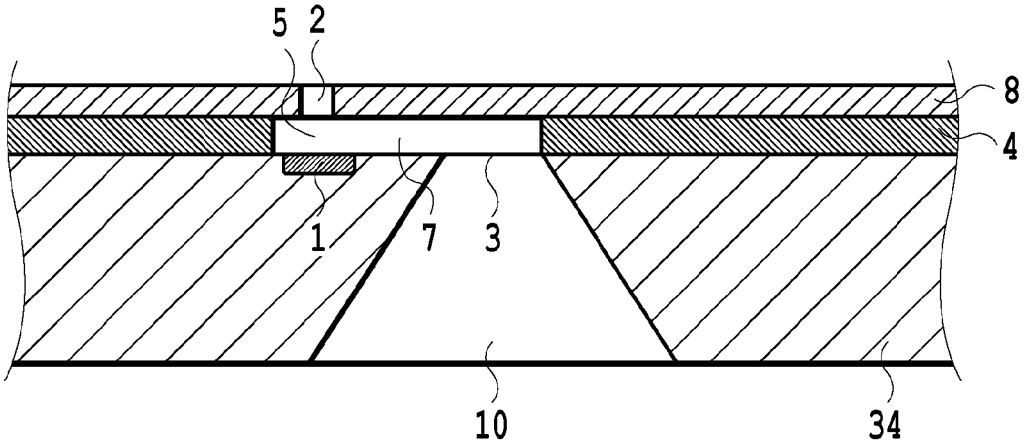
FIG. 2 is a cross section of the print head taken along line II-II' in FIG. 1.

FIG. 1 is a schematic perspective view of a print head according to an embodiment in the present invention. FIG. 2 is a cross section of the print head taken along line II-II' in FIG. 1.

By referring to FIG. 1, the print head includes a substrate 34, a flow passage forming portion 4 provided on one surface of the substrate 34, and an ejection opening plate 8 jointed onto the flow passage forming portion 4. Thermoelectric conversion elements 1 as ejection energy generating elements acting on ink ejection and ink supply ports 3 as elongated, rectangular openings are formed on the one surface of the substrate 34. The thermoelectric conversion elements 1 are arranged to form one row in the longitudinal direction in each of both sides of the ink supply port 3, preferably in a zigzag manner and with an interval between the thermoelectric conversion elements 1 being equal to a pitch of 600 dpi. Ejection openings 2 penetrating through the ejection opening plate 8 are provided in the ejection opening plate 8 to correspond to the thermoelectric conversion elements 1. The substrate 34 is further provided with groove-shaped ink supply chambers 10 each communicated with the ink supply port 3 and having an opening on a surface of the substrate 34 opposite to the surface on which the thermoelectric conversion elements 1 are formed.

By referring to FIG. 2, the substrate 34 forms liquid flow passages 7 and bubble releasing chambers 5 together with the flow passage forming portion 4 and the ejection opening plate 8. The bubble releasing chamber 5 is provided on the thermoelectric conversion element 1 and the liquid flow passage 7 is formed to lead ink introduced via the ink supply port 3 from the ink supply chamber 10 to the bubble releasing chamber 5. The ejection opening 2 provided to penetrate through the ejection opening plate 8 is a tubular opening for establishing communication between the bubble releasing chamber 5 and an outside. When the energy is applied to the ink accommodated in the bubble releasing chamber 5 from the thermoelectric conversion element 1, ink drops are ejected from the ejection opening 2.

In the present embodiment, a silicon substrate is used as the substrate 34, but a material of the substrate 34 is not particularly limited as long as the substrate 34 can function as a support body of ejection energy generating means (thermoelectric conversion element 1), a material layer (flow passage forming portion 4) forming the liquid flow passage, and the like. In the present embodiment, the ejection opening plate 8 and the flow passage forming portion 4 are made of the same material, but the similar effect can be obtained even if made of different materials. In addition, the thermoelectric conversion element (heater) is used as the energy generating element used for ejecting liquid drops, but, not limited thereto, an element capable of controlling ejection of liquid drops by an electrical signal, such as a piezo element, may be used.

First Embodiment

A first embodiment in the present invention will be shown as follows.

Figure 3A:
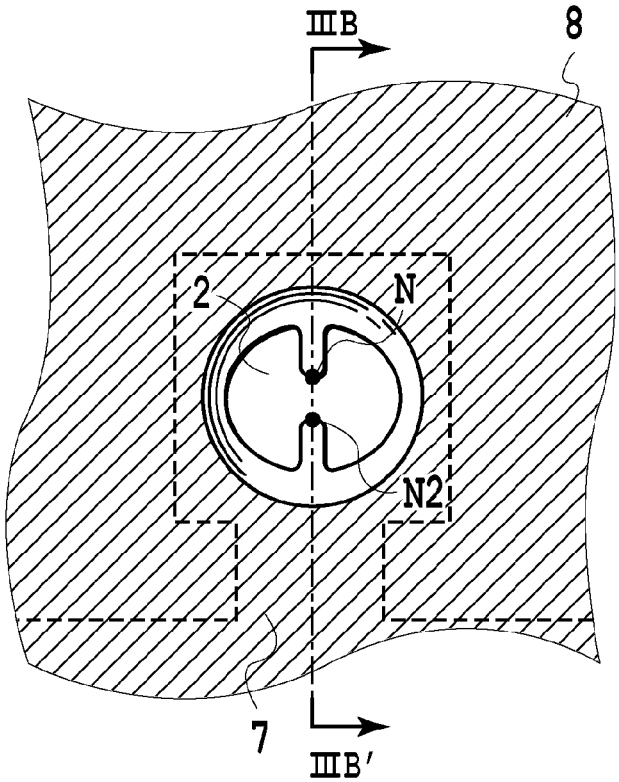
FIG. 3A is a front view of an ejection opening of the print head according to a first embodiment.
Figure 3B:
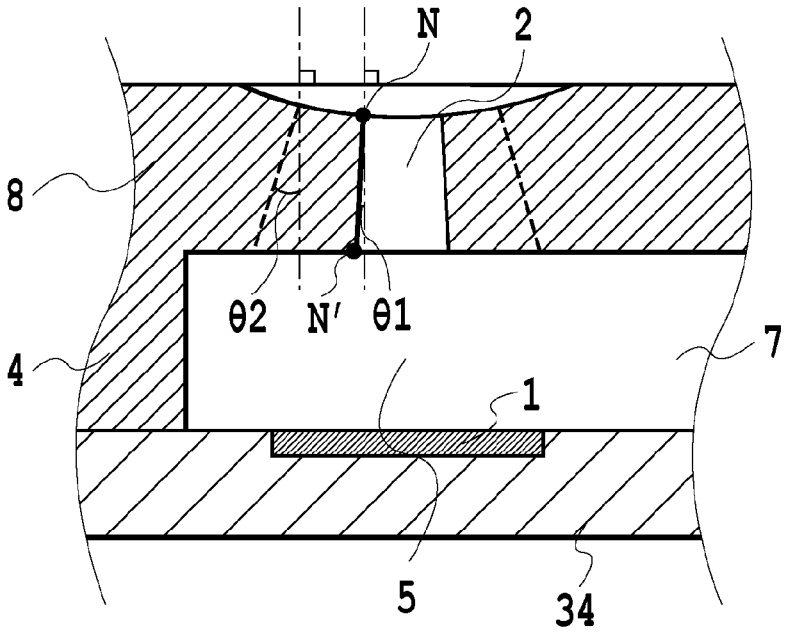
FIG. 3B is a cross section of the ejection opening in the print head taken along line IIIB-IIIB' in FIG. 3A.

FIG. 3A is a front view of the ejection opening in the ejection opening plate 8 in the print head according to the present embodiment. FIG. 3B is a cross section of the ejection opening in the print head taken along line IIIB-IIIB' in FIG. 3A.

By referring to FIG. 3A, the ejection opening 2 of the print head in the first embodiment has two opposing projections convex toward an inside of the ejection opening and an arc portion connecting the two projections, which is a so-called "ejection opening with projections". The line IIIB-IIIB' is drawn to pass front end portions N and N2 of the two projections an interval of which is the shortest.

In a cross section in FIG. 3B, the front end portion of the projection in the ejection opening 2 of the print head in the first embodiment extends to draw a substantially perpendicular line to the upper surface of the ejection opening plate 8 in the thickness direction of the ejection opening plate 8 (refer to line N-N'). Since the perpendicular line to the upper surface of the ejection opening plate 8 is in parallel with an ejection direction at the time of ejecting liquids from the ejection opening, a configuration of such a projection is called "a parallel configuration" hereinafter. A tapered angle (Θ1) relating to the liquid ejection direction which the projection of the parallel configuration in the present invention can have will be described later. On the other hand, a section of the ejection opening 2 (hereinafter, called an outer edge portion) different from the part of the projection is formed in a tapered shape in such a manner that the outer edge portion is the wider as it is closer to the bubble releasing chamber 5 in the thickness direction of the ejection opening plate 8. Therefore the ejection opening 2 is formed in a circular truncated core as a whole. Hereinafter, this configuration of the outer edge portion is called "a tapered configuration". A tapered angle (Θ2) relating to the liquid ejection direction which the outer edge portion of the tapered configuration in the present invention can have will be described later.

In the present embodiment, the outer surface of the ejection opening plate 8 corresponding to the upper surface of the ejection opening 2 is recessed in a concave shape, but since this recess is extremely small, an influence of the recess on ejection performance of the ejection opening can be ignored. The recess in the concave shape is formed in relation to a manufacturing method of the print head to be described later, and is not a necessary element in view of the effect in the present invention.

(Ejection Stability at Printing Start)

Tests in regard to the ejection stability of the ejection opening in the print head in the present embodiment at a printing start were made.

Figure 4A:
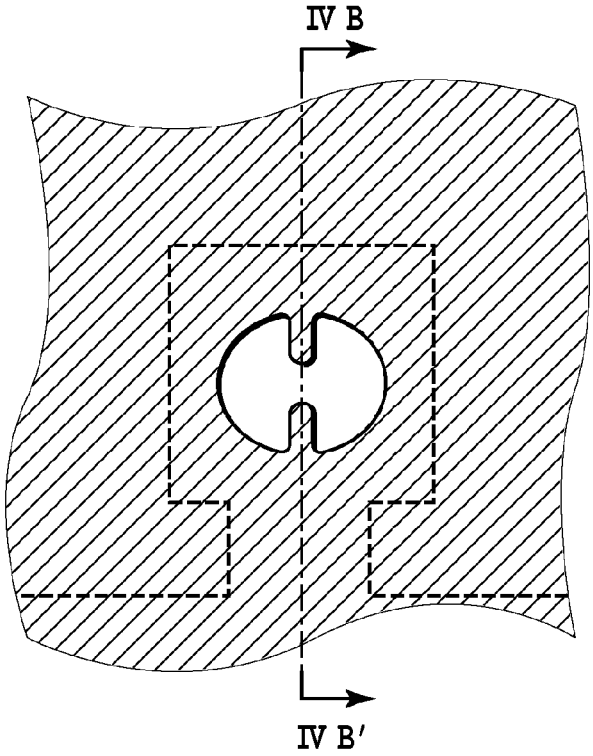
FIG. 4A is a front view of an ejection opening in a print head according to a comparative example.
Figure 4B:
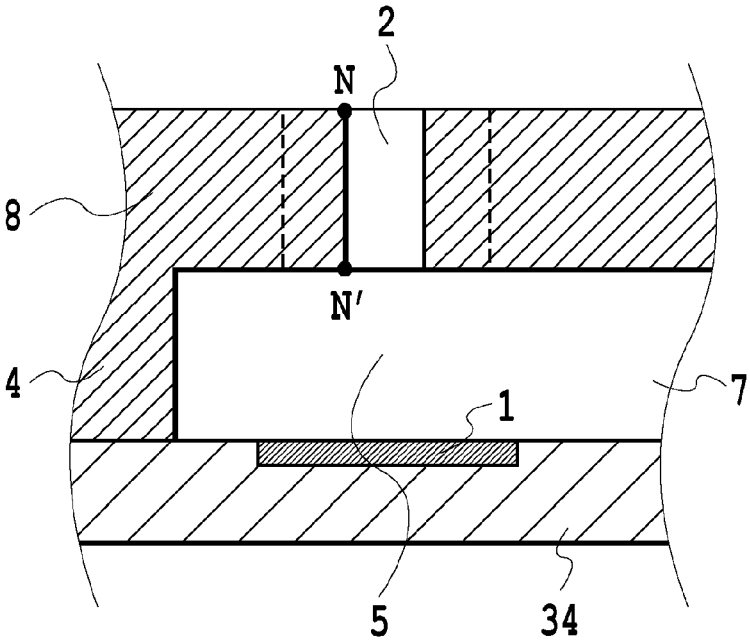
FIG. 4B is a cross section of the ejection opening in the print head taken along line IVB-IVB' in FIG. 4A.

By referring to FIG. 3A and FIG. 3B, in the ejection opening with the projections according to the present embodiment, the projection has the parallel configuration and the outer edge portion has the tapered configuration. In detail, in regard to the ejection opening with the projections in the embodiment, the tapered angle Θ1 of the projection was defined as 0° and the tapered angle Θ2 of the outer edge portion was defined as 10°. By referring to FIG. 4A and FIG. 4B, an ejection opening with projections in which the projection and the outer edge portion both have the parallel configuration was adopted as a comparative example. In other words, in regard to the ejection opening with the projections in the comparative example, the projection and the outer edge portion both have the parallel configuration and the tapered angle θ1 of the projection was defined as 0° and the tapered angle θ2 of the outer edge portion was defined as 0°. That is, the ejection opening with the projections in the present embodiment is in common with the comparative example in a point where the projection has the parallel configuration and is different from the comparative example in a point where the outer edge portion has the tapered configuration.

Table 1 relates to evaluations of ejection stability at a printing start and shows a result where printing starts immediately after a predetermined printing stop time elapses, to measure whether or not ink is ejected normally. The used inks were three colors of cyan, magenta, and yellow. For easy determination of a difference in performance of the ejection openings, the ink difficult in the ejection stability at the printing start was adopted. In table 1, a mark A indicates normal ejection, a mark B indicates non-ejection, and a mark C indicates deviation occurrence in the ejection direction.

TABLE 1

| Printing stop time | Tapered angle Θ2 0° | Tapered angle Θ2 10° |
|---|---|---|
| Cyan | | |
| 2.3 sec | A | A |
| 3.2 sec | B | A |
| 4.1 sec | B | A |
| Magenta | | |
| 2.3 sec | A | A |
| 3.2 sec | C | A |
| 4.1 sec | B | A |
| Yellow | | |
| 2.3 sec | B | A |
| 3.2 sec | B | A |
| 4.1 sec | B | A |

From the result of the tests, it was found out that the ejection opening with the projections in the print head according to the present embodiment could normally eject even if the printing stop time became long and had excellent ejection stability at the printing start.

(Reduction Performance on Satellites and Mists)

The reduction performance on satellites and mists in the ejection opening in the print head according to the present embodiment was studied. Factors of the generation of the satellite and mist include an ink tail phenomenon of liquid drops at ejection, and there is a tendency that as the ink tail is the longer, the satellite and mist tend to be easily generated. Therefore the evaluation by simulation of the ejection process was made in view of a length of the ink tail of the liquid drop as an index of the satellite and mist reduction performance.

Figures 5A, 5B, 5C, 5D, 5E, 5F, 5G:
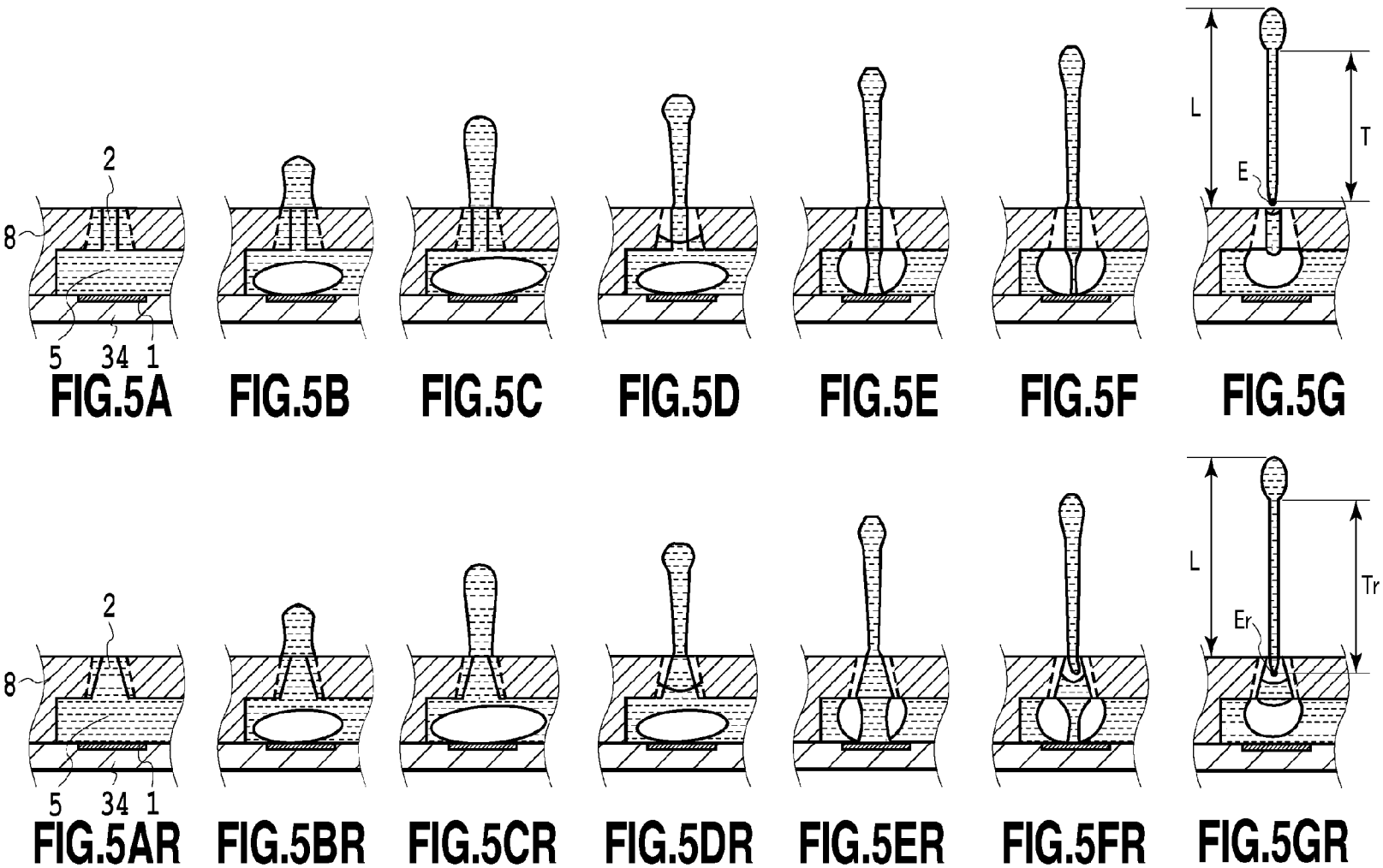
FIG. 5A is a diagram showing the ink ejection process of the print head according to the first embodiment.
FIG. 5B is a diagram showing the ink ejection process of the print head according to the first embodiment.
FIG. 5C is a diagram showing the ink ejection process of the print head according to the first embodiment.
FIG. 5D is a diagram showing the ink ejection process of the print head according to the first embodiment.
FIG. 5E is a diagram showing the ink ejection process of the print head according to the first embodiment.
FIG. 5F is a diagram showing the ink ejection process of the print head according to the first embodiment.
FIG. 5G is a diagram showing the ink ejection process of the print head according to the first embodiment.

FIG. 5A to FIG. 5G show the simulation result of the ejection process at the time of ejecting liquid drops from the ejection opening in the embodiment. Here, in the ejection opening with the projections in the embodiment, the tapered angle Θ1 of the projection was defined as 0° and the tapered angle Θ2 of the outer edge portion was defined as 5°. FIG. 5AR to FIG. 5GR show the simulation result of the ejection process at the time of ejecting liquid drops from the ejection opening in the comparative example. Here, in the ejection opening with the projections in the comparative example, the tapered angle Θ1 of the projection was defined as 15° and the tapered angle Θ2 of the outer edge portion was defined as 5°. FIG. 5A to FIG. 5G correspond to FIG. 5AR to FIG. 5GR in the respective processes.

By referring to FIG. 5A to FIG. 5G, the simulation result in the present embodiment will be explained. FIG. 5A shows a state of the ejection opening in a steady state. When the heater (thermoelectric conversion element 1) is operated, an air bubble is generated and inflated in the bubble releasing chamber 5, thereby ejecting a liquid drop from the ejection opening 2 in the upper part of the bubble releasing chamber 5. Here, FIG. 5B shows a bubble releasing and air-bubble inflating process, and FIG. 5C shows the maximum bubble releasing process. Next, FIG. 5D shows a deforming process, wherein the air bubble is gradually contracted. When the liquid to be ejected starts with separation from the liquid in the ejection opening, the meniscus is generated in the ejection opening. In the process shown in FIG. 5E, the liquid forming the meniscus is pulled in the heater direction, and the liquid drops in the peripheral portion (including the outer edge portion) other than between the projections earlier than between the projections. From the process shown in FIG. 5E over the process shown in FIG. 5F, the connection between the liquid forming the meniscus between the projections and the liquid which has dropped earlier is gradually thin, and further, when the process goes to the process shown in FIG. 5G, the liquid to be ejected is completely separated from the liquid forming the meniscus in the ejection opening and the liquid remains between the projections only.

By referring to FIG. 5AR to FIG. 5GR, the simulation result in the comparative example will be explained primarily focusing on differences from the embodiment. The comparative example is the same as the embodiment in a point where, when the meniscus is generated in the process shown in FIG. 5DR, the liquid forming the meniscus is pulled in the heater direction in the processes shown in FIG. 5ER to FIG. 5FR, and the liquid drops in the outer edge portion of the ejection opening earlier than between the projections. On the other hand, the embodiment is different from the comparative example in a point where in the embodiment, the projection of the ejection opening has the parallel configuration and in the comparative example, the projection of the ejection opening has the tapered configuration, having a tapered angle of 15°. Since the projection of the ejection opening has the tapered configuration in the comparative example, a distance between the projections is the wider from the outer surface side of the ejection opening plate 8 toward the bubble releasing chamber 5. That is, in the comparative example, as the interval between the projections holding the liquid for forming the meniscus is the closer to the bubble releasing chamber 5, it is the wider, thereby reducing the holding force. By referring to FIG. 5G and FIG. 5GR, the upper surface of the meniscus between the projections in the comparative example is in a lower position than in the embodiment.

Here, a length of the ink tail in the liquid drop to be ejected will be studied. When an ejection speed of the liquid drop in the embodiment is the same as that in the comparative example, a position of the front end portion in the liquid drop to be ejected is the same between the embodiment and the comparative example, and in the figures, is positioned at a distance L from the outer surface of the ejection opening plate 8. On the other hand, each of terminal ends (in the figures, indicated at E and Er) of the ink tails (in the figures, indicated at T and Tr) of the liquids to be ejected at the time the liquid to be ejected is completely separated from the liquid forming the meniscus in the ejection opening is positioned in the vicinity of the upper surface of the meniscus. Then, in the embodiment where the upper surface of the meniscus is positioned in the vicinity of the outer surface of the ejection opening plate 8 in the further upper side, the length of the ink tail is shorter than in the comparative example ($T<Tr$).

Therefore, according to the ejection opening of the print head in the present embodiment, the length of the ink tail in the liquid to be ejected can be shorter, thus providing the print head having more excellent performance on a reduction of the satellite and mist generated from the ink tail portion.

(Configuration of Ejection Opening with Projections)

In the embodiment, the tapered angle $\Theta 1$ of the projection is set to 0° and the tapered angle $\Theta 2$ of the outer edge portion is set to 10° or 5°, but the configuration of the ejection opening with the projections which can be applied in the print head in the present embodiment is not limited thereto.

The projection of the ejection opening with the projections in the print head in the present embodiment has the parallel configuration, that is, the tapered angle $\Theta 1$ of substantially 0°, in detail preferably the tapered angle $\Theta 1$ of ≥0° and 10°.

The outer edge portion of the ejection opening with the projections in the print head in the present invention has the tapered configuration, and the tapered angle $\Theta 2$ is in detail preferably set to meet a formula of $\Theta 2>\Theta 1$.

According to the print head in the present invention provided with the ejection opening with the projections having the projection and the outer edge portion described above, both of the ejection stability at the printing start and the reduction performance on the satellite and mist can be achieved in a balanced manner.

(Manufacturing Method of Print Head in First Embodiment)

A method of forming the ejection opening of the print head according to the first embodiment will be explained with reference to FIG. 6A to FIG. 6H.

Figure 6A:
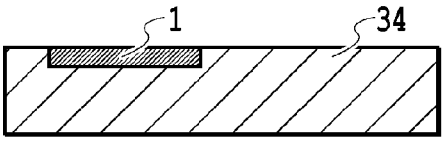
FIG. 6A is a diagram showing a method of forming the ejection opening in the print head according to the first embodiment.

In the process shown in FIG. 6A, the substrate 34 is first provided, and thermoelectric conversion element 1 generating energy for ejecting ink is arranged on the substrate 34. In the process shown in FIG. 6B, a photopolymer is coated on the substrate 34 on which the thermoelectric conversion element 1 is arranged to form a first photopolymer layer 50 which is a mold of the bubble releasing chamber 5 and the liquid flow passage 7, and the photopolymer layer 50 is exposed and developed to pattern the bubble releasing chamber 5 and the liquid flow passage 7. Next, in the process shown in FIG. 6C, the photopolymer is coated to cover the pattern of the bubble releasing chamber 5 and the liquid flow passage 7 to forma second photopolymer layer 80 which is designed to form the flow passage forming portion 4 and the ejection opening plate 8 in FIG. 1 integrally.

Here, in the process shown in FIG. 6D, for forming a recess in a concave shape (hereinafter, called a concave portion) on the second photopolymer layer, the second photopolymer layer is exposed via a mask M in such a manner that the concave portion becomes a non-exposure portion. Removing the mask, in the process shown in FIG. 6E, thermal treatment (Post Exposure Bake) is executed in a temperature equal to or more than a softening point of the resin in the second photopolymer layer. In consequence, the resin of the second photopolymer layer in the exposure portion exposed in the previous process is solidified and contracted. The resin of the second photopolymer layer in the non-exposure portion is heated to the softening point or more for softening, and, caused by the solidification and the contraction of the resin in the aforementioned exposure portion, the concave portion equivalent to the contracted volume is formed.

Figure 6B:
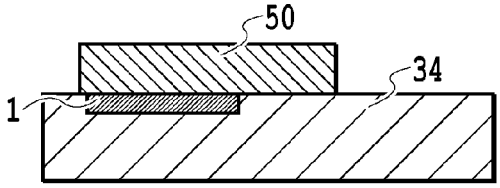
FIG. 6B is a diagram showing a method of forming the ejection opening in the print head according to the first embodiment.
Figure 6C:
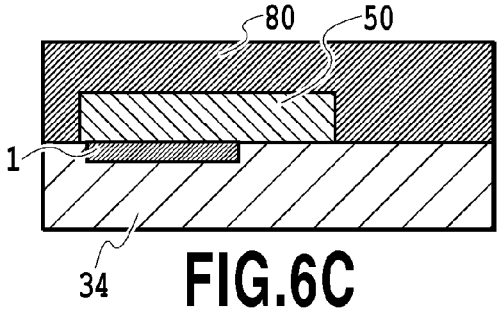
FIG. 6C is a diagram showing a method of forming the ejection opening in the print head according to the first embodiment.
Figure 6D:
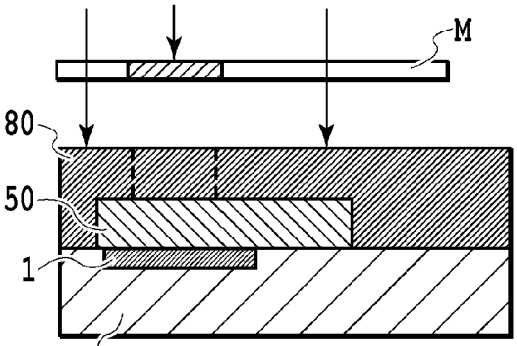
FIG. 6D is a diagram showing a method of forming the ejection opening in the print head according to the first embodiment.
Figure 6E:
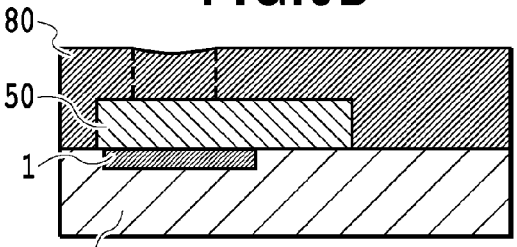
FIG. 6E is a diagram showing a method of forming the ejection opening in the print head according to the first embodiment.
Figure 6F:
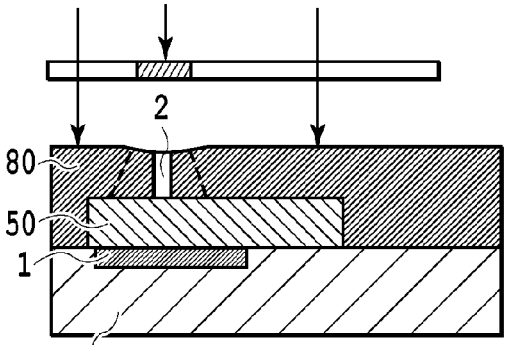
FIG. 6F is a diagram showing a method of forming the ejection opening in the print head according to the first embodiment.
Figure 7:
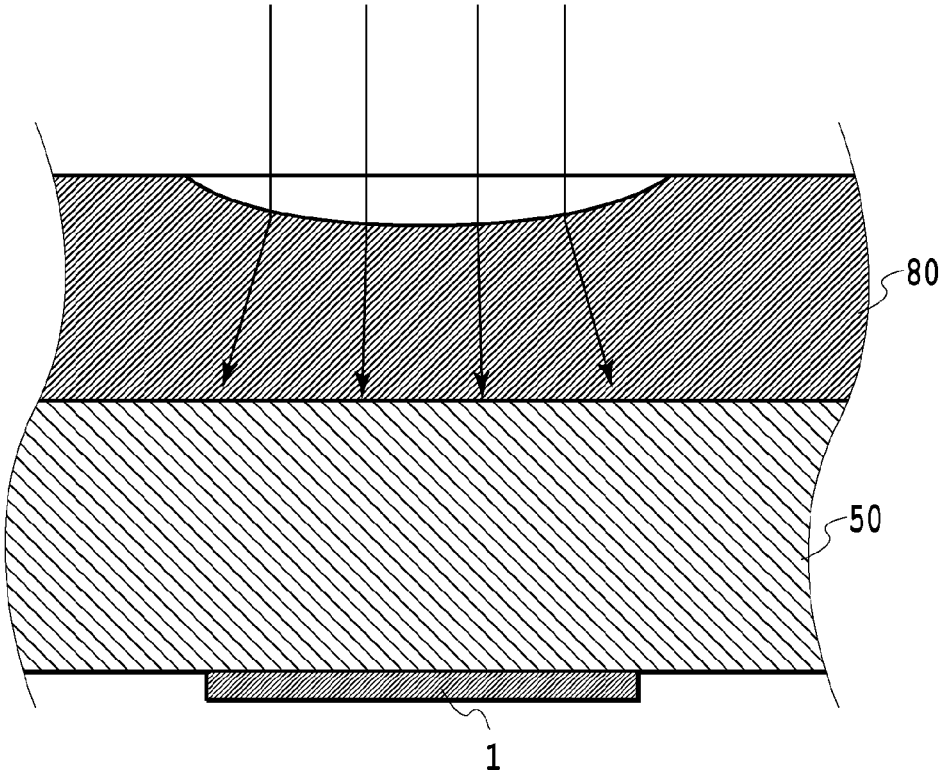
FIG. 7 is a concept diagram of incident light at an ejection opening exposure time in the manufacture of the print head according to the first embodiment.

In the process shown in FIG. 6F, the ejection opening with the projections is patterned by being exposed and developed in the concave portion formed in the previous process to produce the ejection opening in the concave portion. Here, at the exposure, in the interface between air and the concave portion, the concave configuration of the concave portion functions as lens due to a difference of a refractive index of light therebetween for incident light to be refracted (refer to FIG. 7). The refraction angle is determined by an inclination angle of the concave portion. As shown in FIG. 7, the outer edge portion of the ejection opening is tapered by large refraction of light, and since part of the projection has small refraction, it is not tapered or almost not tapered.

Figure 6G:
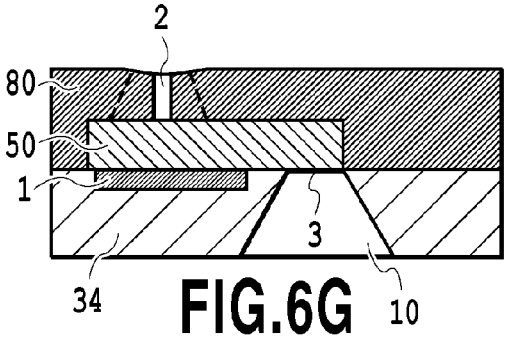
FIG. 6G is a diagram showing a method of forming the ejection opening in the print head according to the first embodiment.

Afterwards, in the process shown in FIG. 6G, anisotropic etching using a difference of an etching speed by a crystal orientation of silicon is used to form the ink supply chamber 10 and the ink supply opening 3 from the back side of the substrate 34, that is, from the reverse side of the bubble releasing chamber and the liquid flow passage forming surface. Finally in the process shown in FIG. 6H, the first photopolymer 50 is melted by a solvent, and the melted portion forms part of the liquid flow passage 7 and the bubble releasing chamber 5. In this manner, the print head according to the present embodiment is manufactured.

In the method of manufacturing the print head according to the present embodiment, since a focus position at exposure for forming the ejection opening 2 is in the surface vicinity of the ejection opening 2, it is possible to form the ejection opening with high dimension accuracy.

A diameter of the configuration of the concave portion can be changed by the mask, and a depth of the concave portion can be controlled by the exposure amount, and a temperature and a time of the thermal treatment. Therefore these factors can be adjusted as needed to correspond to a dimension of the ejection opening with the projections to be formed.

Second Embodiment

Next, a second embodiment in the present invention will be explained with reference to FIG. 8A to FIG. 8G. The second embodiment shows different forming means of the ejection opening in the print head of the first embodiment, and has the same construction as that in the first embodiment in the other points. Therefore hereinafter, only the forming means of the ejection opening will be explained and the overlapped explanation is omitted.

(Method of Manufacturing Print Head according to Second Embodiment)

Figure 6H:
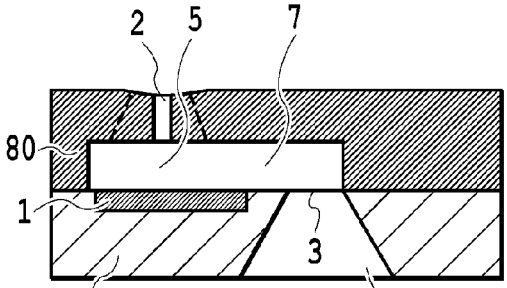
FIG. 6H is a diagram showing a method of forming the ejection opening in the print head according to the first embodiment.
Figure 8A:
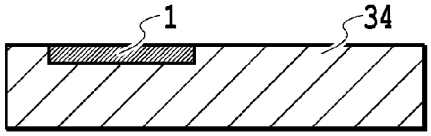
FIG. 8A is a diagram showing a method of forming an ejection opening in a print head according to a second embodiment.
Figure 8B:
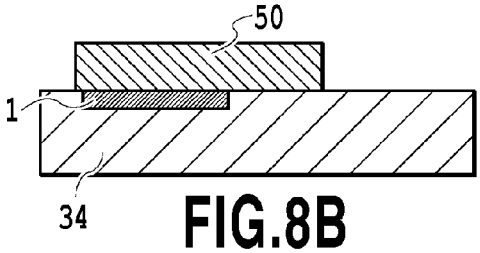
FIG. 8B is a diagram showing a method of forming an ejection opening in a print head according to a second embodiment.
Figure 8C:
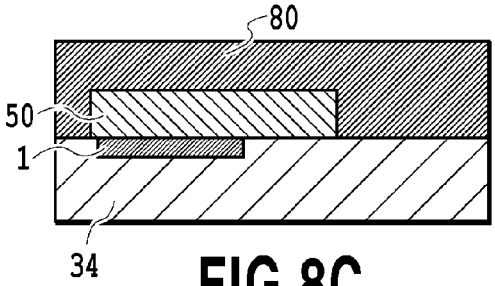
FIG. 8C is a diagram showing a method of forming an ejection opening in a print head according to a second embodiment.
Figure 8D:
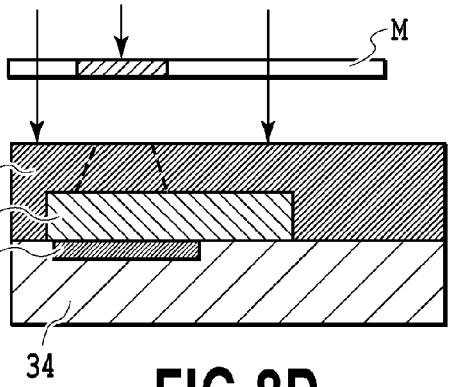
FIG. 8D is a diagram showing a method of forming an ejection opening in a print head according to a second embodiment.
Figure 8E:
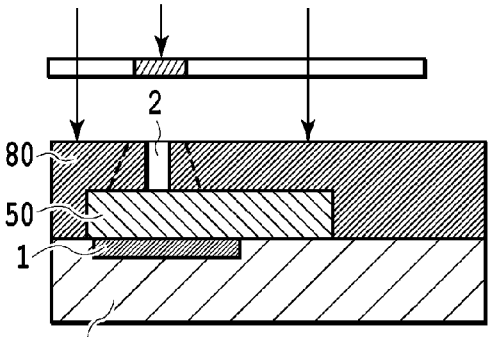
FIG. 8E is a diagram showing a method of forming an ejection opening in a print head according to a second embodiment.
Figure 8F:
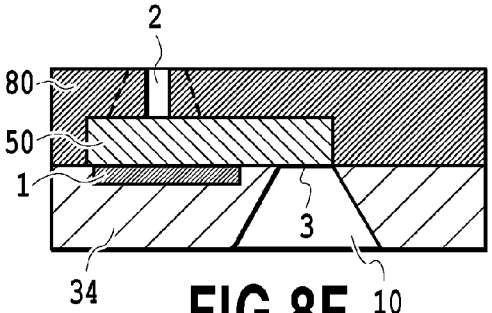
FIG. 8F is a diagram showing a method of forming an ejection opening in a print head according to a second embodiment.
Figure 8G:
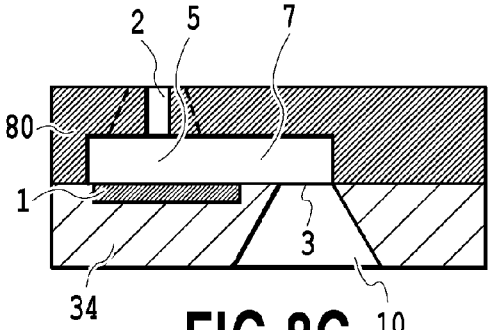
FIG. 8G is a diagram showing a method of forming an ejection opening in a print head according to a second embodiment.

In the forming method of the ejection opening of the print head in the second embodiment shown in FIG. 8A and FIG. 8G, since the processes shown in FIG. 8A to FIG. 8C are the same as the processes from FIG. 6A to FIG. 6C in the forming method of the ejection opening of the print head in the first embodiment shown in FIG. 6A and FIG. 6H and the subsequent processes are different, an explanation will start with the process shown in FIG. 8D.

In the forming method of the ejection opening of the print head in the second embodiment, the exposure of the outer edge portion and the exposure of the projection in the ejection opening with the projections are respectively made separately. First, in the process shown in FIG. 8D, the first exposure is made to the second photopolymer layer 80 to form the outer edge portion in the ejection opening. By shifting the focus (imaging position) to the heater side at the exposure, light incomes inside of the contour of the mask pattern on the outer surface side of the second photopolymer layer. That is, the same configuration as the mask pattern is projected in the imaging position in the heater side, and the light incomes inside of the mask pattern as being away from the imaging position. Therefore an image as the side wall of the ejection opening spreads from the outer surface side of the second photopolymer layer toward the imaging position, thereby to form the tapered configuration. In this manner, only the outer edge portion of the ejection opening with the projections is formed in a tapered configuration by the first exposure. Afterwards, in the process shown in FIG. 8E, the second exposure is made to form the projection. In the second exposure, the focus is adjusted to be imaged in the outer surface side of the second photopolymer layer for the part of the projection not to be tapered for exposure. The processes in FIG. 8F and FIG. 8G after forming the ejection opening with the projections by the exposure and the development in this manner are the same as those shown in FIG. 6G and FIG. 6H in the first embodiment.

As described above, since the outer edge portion of the ejection opening with the projections has the tapered configuration and the projection has the parallel configuration, the print head provided with the ejection opening excellent in both of the ejection stability at a printing start and the reduction performance of the satellite and the mist can be achieved.

Third Embodiment

Figure 9:
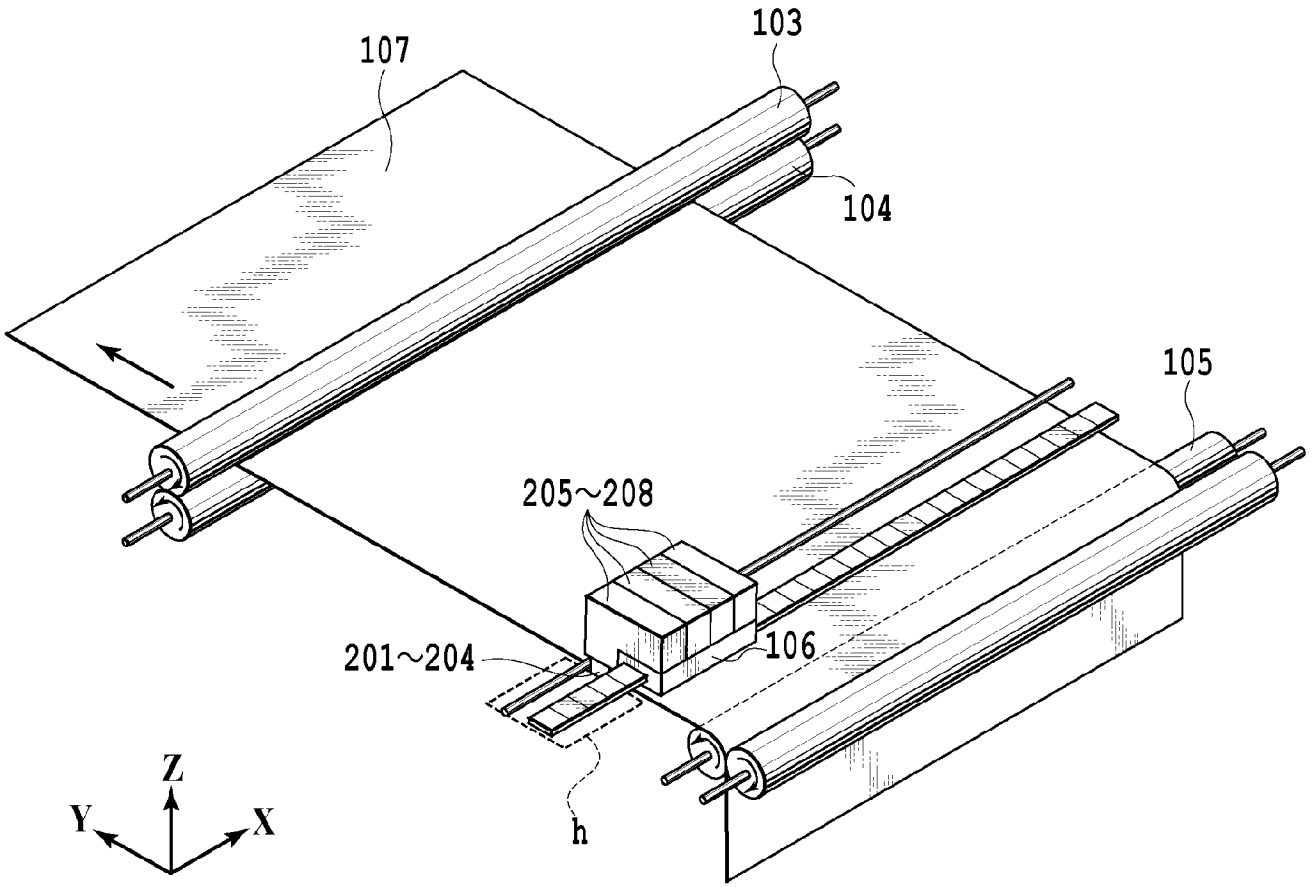
FIG. 9 is a schematic perspective view of an inkjet printing apparatus according to a third embodiment.

FIG. 9 is a schematic perspective view showing one construction example of an inkjet printing apparatus according to a third embodiment. The inkjet printing apparatus according to the third embodiment uses the print head having the same construction as that of the first embodiment as one example of the print head according to the present invention. Therefore an overlapped explanation will be hereinafter omitted.

Ink tanks 205 to 208 respectively accommodate four colors of inks (cyan, magenta, yellow, and black), and are structured to supply the four colors of the inks to the print heads 201 to 204 in the first embodiment. The print heads 201 to 204 are provided corresponding to the four colors of the inks and are structured to eject the inks supplied from the ink tanks 205 to 208. For reducing the granularity of a print image, ink drops ejected from each print element arranged in the print head are set to small ink drops of a fixed amount.

A conveyance roller 103 rotates together with an auxiliary roller 104 while having a print medium (print sheet) 107 therebetween, and conveys and holds the print medium 107. A carriage 106 can mount the ink tanks 205 and 208 and the print heads 201 to 204, and reciprocally moves along the X direction while mounting the print heads and the ink tanks thereon. Ink is ejected from the print head during the reciprocal movement of the carriage 106, thereby printing an image on the print medium. At a non-printing operation such as at a recovery operation of the print heads 201 to 204, the carriage 106 is controlled to wait in the home position h shown in a dotted line in the figure.

The print heads 201 to 204 waiting in the home position h shown in FIG. 1, when a printing start command is inputted thereto, move together with the carriage 106 in the X direction in the figure and eject ink to print an image on the print medium 107. The printing is performed onto a region having a width corresponding to an arrangement range of the ejection openings in the print head 201 by one time movement (scan) of the print head. When the printing by one time scan of the carriage 106 in the main scan direction (X direction) is completed, the carriage 106 returns back to the home position h, wherein the printing is performed by the print heads 201 to 204 while again scanning in the X direction in the figure. Before start of a subsequent printing scan following completion of the previous printing scan, the conveyance roller 103 rotates to convey the printing medium in the sub scan direction (Y direction) intersecting with the main scan direction. By thus repeating the printing scan of the print head and the conveyance of the print medium, the printing of the image on a predetermined region of the print medium 107 is completed. The printing operation for ejecting ink from the print heads 201 to 204 is performed based upon control by control means to be described later.

In the above example, the printing operation is performed only when the print head scans in the forward direction, that is, a case of performing so-called one-way printing is explained. However, the present invention can be applied to a print head of performing so-called bidirectional printing in which the print head performs printing at both scans in the forward and backward directions. The above example shows the structure that the ink tanks 205 to 208 and the print heads 201 to 204 are mounted in the carriage 106 to be separable. However, there may be adopted the structure of mounting on a carriage a cartridge where the ink tanks 205 to 208 and the print heads 201 and 204 are formed integrally. Further, there may be adopted the structure of mounting on a carriage an integral print head of plural colors capable of ejecting inks of plural colors from one print head.

The inkjet printing apparatus according to the present embodiment is explained as a so-called serial type of inkjet printing apparatus for performing printing while the print head scans in the main scan direction (X direction). However, the print head used in the inkjet apparatus according to the present invention may be a full line type of print head for printing without scanning in the main scan direction. At this time, the print head to be used may be a single print head having a length corresponding to that of the print medium in the width direction or may be a combination of plural print heads.

Other Embodiment

The print head according to the above embodiment is explained as the structure of using the ejection opening having two opposing projections each formed to be convex in the inside direction in a cross section perpendicular to the ejection direction of the liquid and having the parallel configuration in the ejection direction of the liquid and the outer edge portion having the tapered configuration in the ejection direction of the liquid. However, the ejection opening applicable to the print head according to the present invention is not limited thereto. The projection is only required to be capable of forming the meniscus of the liquid in the ejection opening at the time of ejecting the liquid from the ejection opening, and may be three or more projections. For obtaining more excellent effects of the present invention, the positions of the projections are preferably provided equally in the inner periphery of the ejection opening. In a case where the number of the projections is an even number, the positions of the projections are preferably symmetrical in the inner periphery of the ejection opening.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-131155, filed Jun. 13, 2011, which is hereby incorporated by reference herein in its entirety.

The invention claimed is:

1. A print head comprising:

an energy generating element;

a chamber for accommodating liquid to which energy is applied from the energy generating element; and an ejection opening for ejecting the liquid from the chamber to an outside, thus applying the energy to the liquid in the chamber from the energy generating element to eject the liquid from the ejection opening, wherein the ejection opening includes:

at least two projections, each of which is convex to an inside of the ejection opening in a cross-section perpendicular to a direction of ejecting the liquid and has a tapered angle Θ1 with respect to the direction of ejecting the liquid, enabling a meniscus of the liquid to be formed therebetween at the time of ejecting the liquid from the ejection opening; and an outer edge portion which is a section of the ejection opening different from the at least two projections and has a tapered angle Θ2 with respect to the direction of ejecting the liquid, wherein the tapered angle Θ1 and the tapered angle Θ2 are defined to meet a formula of $0° \leq \Theta 1 \leq 10°$ and a formula of $\Theta 2 > \Theta 1$.

2. An inkjet printing apparatus using a print head, the print head comprising:

an energy generating element;

a chamber for accommodating liquid to which energy is applied from the energy generating element; and an ejection opening for ejecting the liquid from the chamber to an outside, thus applying the energy to the liquid in the chamber from the energy generating element to eject the liquid from the ejection opening, wherein the ejection opening includes:

at least two projections, each of which is convex to an inside of the ejection opening in a cross-section perpendicular to a direction of ejecting the liquid and has a tapered angle Θ1 with respect to the direction of ejecting the liquid, enabling a meniscus of the liquid to be formed therebetween at the time of ejecting the liquid from the ejection opening; and an outer edge portion which is a section of the ejection opening different from the at least two projections and has a tapered angle Θ2 with respect to the direction of ejecting the liquid, wherein the tapered angle Θ1 and the tapered angle Θ2 are defined to meet a formula of $0° \leq \Theta 1 \leq 10°$ and a formula of $\Theta 2 > \Theta 1$.

3. A liquid ejecting head comprising:

an element for generating energy used for ejecting liquid;

a chamber for accommodating the liquid to which the energy is applied from the element; and an ejection opening for communicating the chamber with an outside to eject the liquid, wherein the ejection opening comprises:

a plurality of projections projecting toward the center of the ejection opening when viewed from a direction in which the liquid is ejected; and a plurality of arc portions connecting the plurality of the projections, wherein a front end portion of each of the projections has a tapered angle Θ1 with respect to the direction of ejecting the liquid and the arc portion has a tapered angle Θ2 with respect to the direction of ejecting the liquid, and wherein the tapered angle Θ1 and the tapered angle Θ2 are defined to meet a formula of $\Theta 2 > \Theta 1$.

4. A liquid ejecting head according to claim 3, wherein in a cross-section in a direction perpendicular to the direction of ejecting the liquid, the ejection opening has a cross-sectional area at an end portion closer to the outside smaller than a cross-sectional area at an end portion closer to the chamber.

5. A liquid ejecting head according to claim 3, wherein the tapered angle Θ1 is defined to meet a formula of $0° \leq \Theta 1 \leq 10°$.

6. A liquid ejecting head according to claim 3, wherein the plurality of projections comprises two projections projecting in directions opposing each other.

* * * * *